United States Patent [19]

Clement et al.

[11] Patent Number: 4,481,391

[45] Date of Patent: Nov. 6, 1984

[54] MOLDED SWITCH HEAD

[75] Inventors: Ralph C. Clement; Charles W. Parmenter, both of Bellefontaine; William T. Lockwood, Huntsville, all of Ohio

[73] Assignee: Siemens-Allis, Inc., Atlanta, Ga.

[21] Appl. No.: 364,081

[22] Filed: Mar. 31, 1982

[51] Int. Cl.[3] ..... H01H 1/42

[52] U.S. Cl. ..... 200/163; 200/303

[58] Field of Search ..... 200/159 A, 260, 293, 200/295, 303, 330, 331, 163

[56] References Cited

U.S. PATENT DOCUMENTS

| | | | |
|---|---|---|---|
| 2,230,428 | 2/1941 | Frank | 200/163 |
| 2,287,676 | 6/1942 | Frank et al. | 200/163 |
| 2,302,849 | 11/1942 | Frank et al. | 200/163 |
| 2,820,123 | 1/1958 | Higgins et al. | 200/260 X |
| 3,098,142 | 7/1963 | Farrell | 200/293 |
| 3,655,925 | 4/1972 | Lincoln et al. | 200/295 X |
| 3,727,157 | 4/1973 | Grunert et al. | 200/295 X |

*Primary Examiner*—Stephen Marcus
*Assistant Examiner*—Ernest G. Cusick
*Attorney, Agent, or Firm*—John L. James

[57] ABSTRACT

An improved switch head for engaging and making electrical contact between first and second stationary electrical conductors. The switch head comprises lower and upper insulating head sections, biasing means and a contact slug contained within the lower insulating head section for contacting and making electrical connection with the first and second stationary conductors, and clamping means for holding the lower and upper insulating head sections together. The clamping means places the lower and upper insulating head sections in compression when the switch head engages the first and second stationary conductors. The clamping means also applies a force to the lower head section to disengage the switch head from the first and second stationary conductors.

8 Claims, 13 Drawing Figures

MOLDED SWITCH HEAD

BACKGROUND OF THE INVENTION

This invention relates to improvements in molded switch heads of the type shown in U.S. Pat. No. 2,820,123 issued to L. W. Higgins, R. S. Davis, and J. A. Herrmann.

Switches of the above noted type, in essence, provide first and second stationary contacts which are engaged and disengaged by a movable contact element or slug. The contact slug is positioned in the switch head and the switch head is further constructed so as to move an insulating barrier between the stationary contacts as the contact slug is moved to a disengaged position. The head is further constructed so as to completely surround the area of contact and engagement with an insulating means. Hence, as the switch head is moved to a disengaged contact position, arcing between the stationary contacts is decreased, first because of the interposition of the insulating barrier and secondly, because the amount of oxygen or ionizable gas present is restricted in view of the insulated enclosure around the contact area.

In the past, it has been the practice to attach an operating clamp to the top of the insulating material of the switch head. The operating clamp provides a means whereby the switch head is moved between the engaged and disengaged positions. The novel switch head disclosed in U.S. Pat. No. 2,820,123 comprises, in part, first and second insulating head sections which telescope together in a horizontal direction. These head sections are held together in an operating clamp which is formed of a spring steel material. It has been found that for short circuit currents of 10,000 amps or less, the head segments can be held together only by the clamp. However, in circuits having possible short circuit currents over 10,000 amps, it is necessary to cement the two head segments together to provide adequate protection when a short occurs. If the head sections are not cemented together in the presence of short circuit currents of over 10,000 amps, it is possible that the head segments will separate.

The present invention provides a solution to the expensive manufacturing step of cementing head segments together, as well as providing an alternative to the expensively formed spring operating clamp.

SUMMARY OF THE INVENTION

The present invention involves an improved switch head for engaging and making electrical contact between first and second stationary electrical conductors. The switch head comprises lower and upper insulating head sections, biasing means and a contact slug contained within the lower insulating head section for contacting and making electrical connection with the first and second stationary conductors, and clamping means for holding the lower and upper insulating head sections together. The clamping means places the lower and upper insulating head sections in compression when the switch head engages the first and second stationary conductors. The clamping means also applies a force to the lower head section to disengage the switch head from the first and second stationary conductors.

OBJECTS OF THE INVENTION

It is a general object of the present invention to provide an improved switch head for electrically connecting stationary electrical conductors.

It is a more specific object of the present invention to provide an improved switch head which is simple in design and inexpensive to manufacture.

It is another object to provide a switch head which is held together only by a clamp.

It is yet another object of the present invention to provide an improved switch head which is stronger in construction than prior art switch heads.

BRIEF DESCRIPTION OF THE DRAWINGS

The features of the present invention which are believed to be novel are set forth with particularity in the appended claims. The invention, together with further objects and advantages thereof, may thus be understood by reference to the following description, taken in conjunction with the accompanying drawings and the several figures of which like reference numerals identify like elements, and in which:

DESCRIPTION OF THE PREFERRED EMBODIMENT

Figure 1:
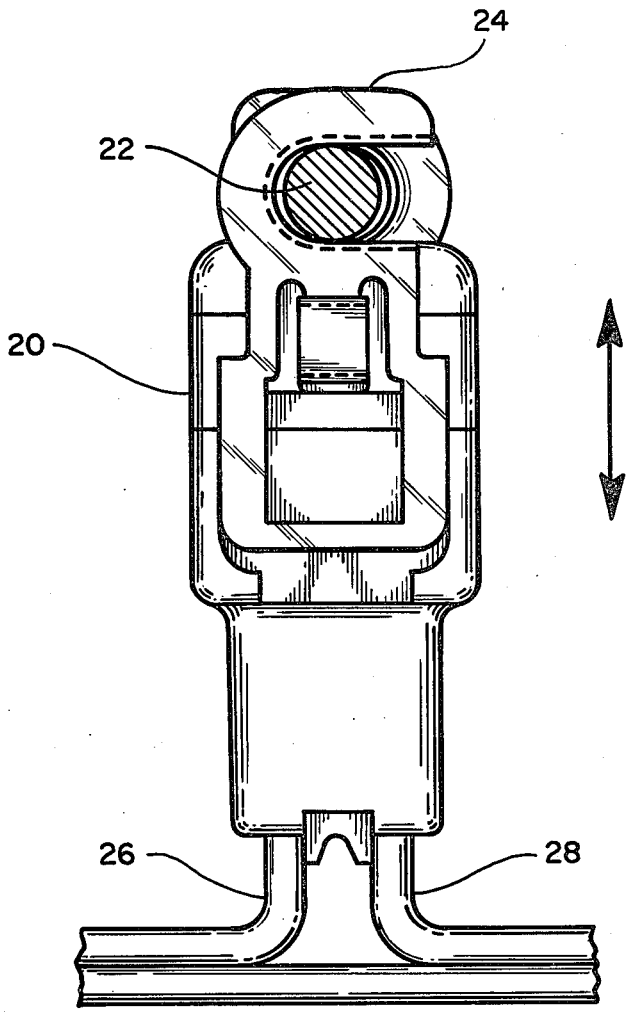
FIG. 1 is a side view of a novel switch head.
Figure 2:
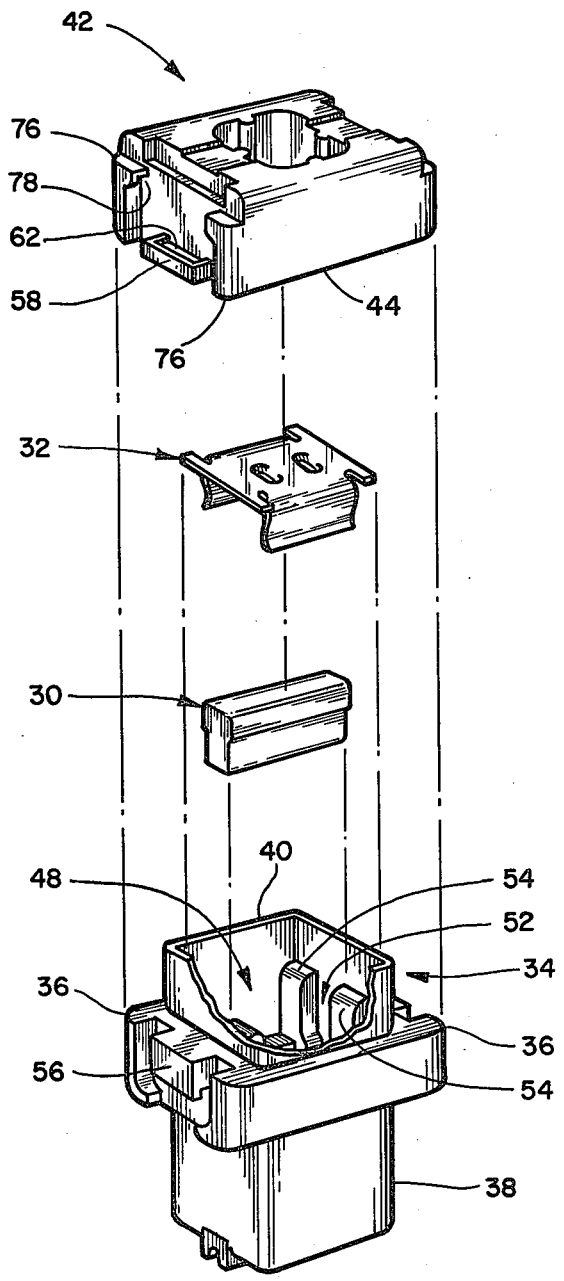
FIG. 2 is an exploded perspective view of the FIG. 1 switch head.

Whereas the invention may be implemented in various types of switch heads, it is preferably embodied in a switch of the nature shown in FIG. 1. FIG. 1 shows a side view of a novel improved switch head 20. A bar 22 moves the switch head 20 by means of a hanger 24 in a vertical direction (shown by the two headed arrow) to engage and disengage the switch head 20 from first and second stationary electrical conductors 26 and 28. The switch head 20 is shown in an exploded perspective view in FIG. 2. Electrical connection is established between the first stationary conductor 26 and the second stationary conductor 28 by contact slug 30 and biasing means 32. The contact slug 30 and the biasing means 32 are made of a metallic material, and the stationary conductors 26 and 28 are engaged between the slug 30 and the biasing means 32 as is disclosed and claimed in U.S. Pat. No. 2,820,123.

In a first embodiment, the novel switch head 20 comprises a body 34 having first and second ends 36 and 38. The first end 36 has a raised flange 40. The switch head also comprises a cap 42 having an outer wall 44 and a center portion 46 for mating with the raised flange 40 of the body 34. The center portion 46 of the cap 42 substantially contacts the biasing means 32 in the body 34 for retaining the biasing means 32 in position. The biasing means 32 and the slug 30 are contained within the body 34.

In general terms, the present invention involves an improved switch head for engaging and making electrical contact between the first and second stationary electrical conductors 26 and 28 and comprises lower and upper insulating head sections which are the body 34 and the cap 42, respectively. The improved switch head further comprises the biasing means 32 and the contact slug 30 contained within the lower insulating head section or body 34. The biasing means 32 and the slug 30 contact and make electrical connections with the first and second stationary conductors 26 and 28. The switch head also comprises a clamping means, such as a clamp 64, for holding the lower and upper insulating head sections 42 together. The clamping means places the lower and upper insulating head sections in compression when the switch head engages the first and second stationary conductors 26 and 28, and the clamping means applies force to the lower head section to disengage the switch head 20 from the first and second stationary conductors 26 and 28. The lower and upper insulating head sections are configured to mate in a vertical telescoping arrangement when the lower and upper insulating head sections are assembled.

Figure 3:
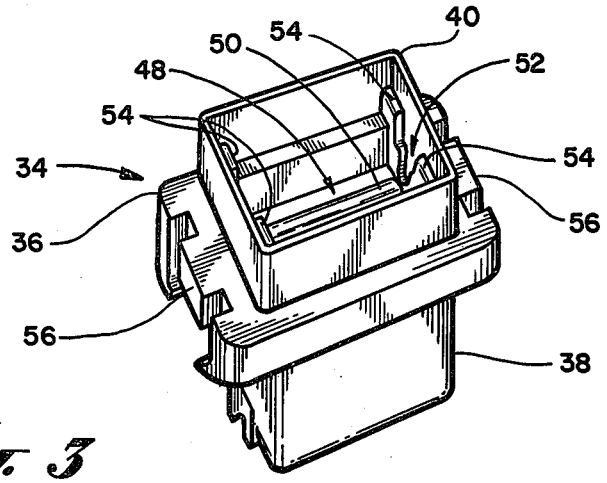
FIGS. 3, 4, and 5 are perspective views of parts of the FIG. 2 switch head.
Figure 4:
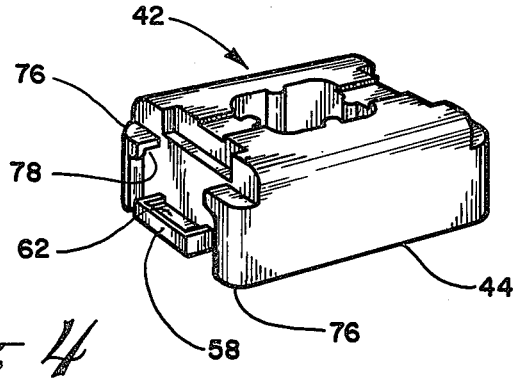
Figure 5:
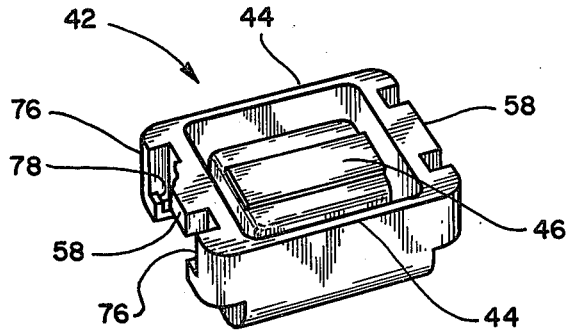
Figure 6:
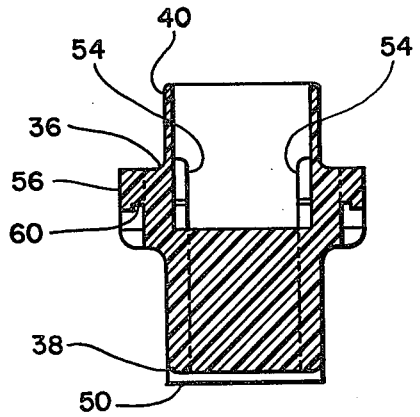
FIGS. 6 and 7 are cross sectional views of parts of the FIG. 2 switch head.
Figure 7:
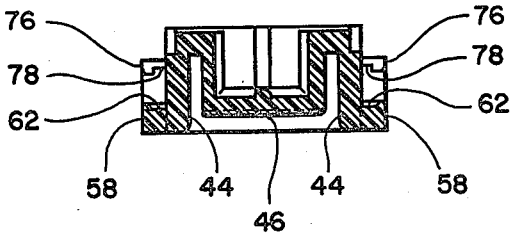

FIGS. 3, 4, and 5 illustrate in more detail the body 34 and cap 42 of one embodiment of the present invention. The seciond end 38 of the body 34 has two rectangular openings 48 separated by a barrier 50 through which the first and second stationary conductors 26 and 28 pass as the switch head 20 engages the conductors 26 and 28. Within the body 34, slots 52 are used to position the contact slug 30, and posts 54 are utilized to position the biasing means 32. The outer wall 44 and center portion 46 of cap 42 are constructed such that they mate with the raised flange 40 of the body 34 in a vertical telescoping arrangement. FIGS. 6 and 7 are cross sectional views of the body 34 and cap 42, respectively, detailing the structure described above.

The body 34 and the cap 42 each have at least two oppositely opposed protruding abutments 56 and 58. The abutments 56 on the body 34 are aligned with the abutments 58 on the cap 42 when the body 34 and the cap 42 are assembled. The abutment 56 on the body 34 has a groove 60 on a lower end of the abutment 56, and the abutment 58 on the cap 42 has a recess 62 on an upper end of the abutment 58. (See FIGS. 6 and 7)

Figure 2A:
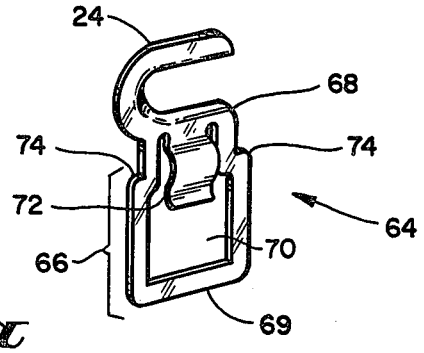
FIG. 2A is a side view of a clamp for use with the FIG. 2 switch head.

The clamping means comprises two identical clamps 64 as shown in FIG. 2A. The clamp 64 comprises a main portion 66 having first and second ends 68 and 69. The central opening 70 is provided in the main portion 66, and a finger 72 is attached to the first end 68 as shown in FIG. 2A. A pair of shoulders 74 is formed on the first end 68 of the main portion 66 and a hanger 24 is also attached to the first end 68. The hanger 24 may be configured in any one of a number of different ways, depending on the type of mechanism used to move the switch head. The cap 42 also has, near each abutment 58, a pair of walls 76, wherein each wall has a clamp engaging portion 78. The clamp engaging portion 78, in the present embodiment, comprises an overhanging section.

After the body 34 and cap 42 are assembled with the contact slug 30 and biasing means 32 contained within the body 34, the clamp 64 is attached and holds the switch head 20 together. The central opening 70 of the main portion 66 surrounds the abutments 56 and 58 on the body 34 and cap 42, respectively. The second end 69 of the main portion 66 engages the groove 60 in the lower end of the abutment 56 on the body 34, and the finger 72 attached to the first end 68 of the main portion 66 engages the recess 62 in the upper end of the abutment 58 on the cap 42. The pair of shoulders 74 on the first end 68 of the main portion 66 engages the clamp engaging portion 78 of the pair of walls 76 on the cap 42. It is understood that once the clamp 64 is positioned on the switch head 20, a force is applied to the finger 72 causing it to engage the recess 62 on the abutment 58. After this force has been applied to the finger 72, the clamp 64 is securely attached to the switch head 20 and prevents the body 34 from separating from the cap 42, even in the presence of severe arcing. The clamp 64 places the body 34 and the cap 42 in compression when the switch head engages the first and second stationary conductors 26 and 28; and furthermore, the clamp 64 applies force to the body 34 to disengage the switch head 20 from the first and second stationary conductors 26 and 28.

The body 34 and the cap 42 may be molded of any one of a number of well known insulating materials. The slug 30 is formed from a metallic material having good electrical conductors properties, and the biasing means 32 may be of spring steel formed in a stamping process. The clamp 64 may be stamped from metal, such as steel, and appropriately plated.

Figure 8:
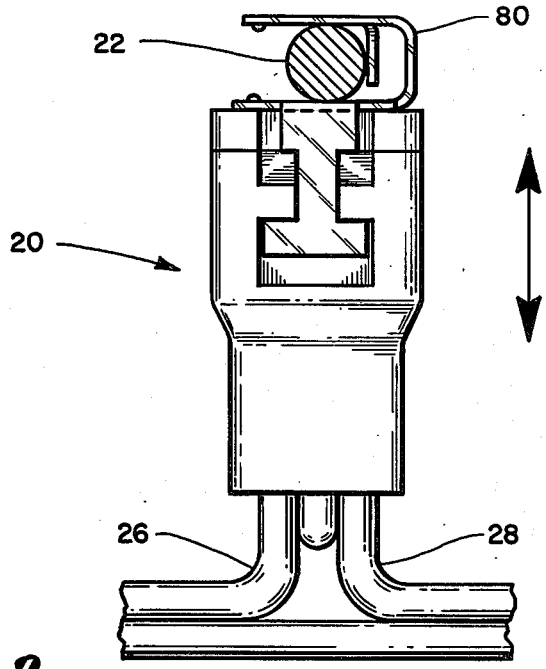
FIG. 8 is a side view of an alternative embodiment of the novel switch head.
Figure 9:
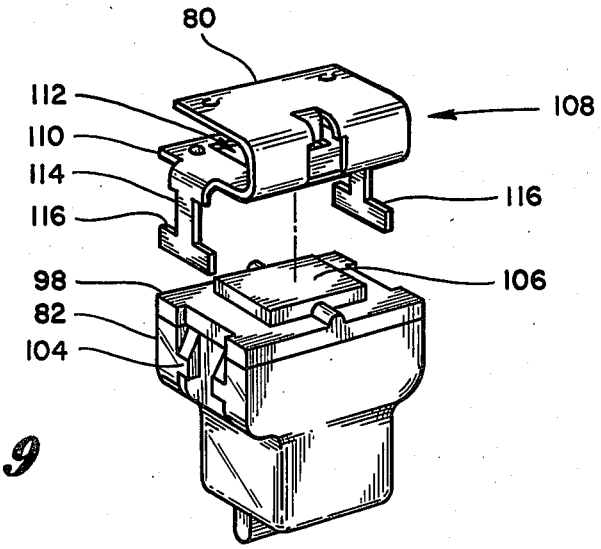
FIG. 9 is a perspective view of the FIG. 8 alternative embodiment.
Figure 10:
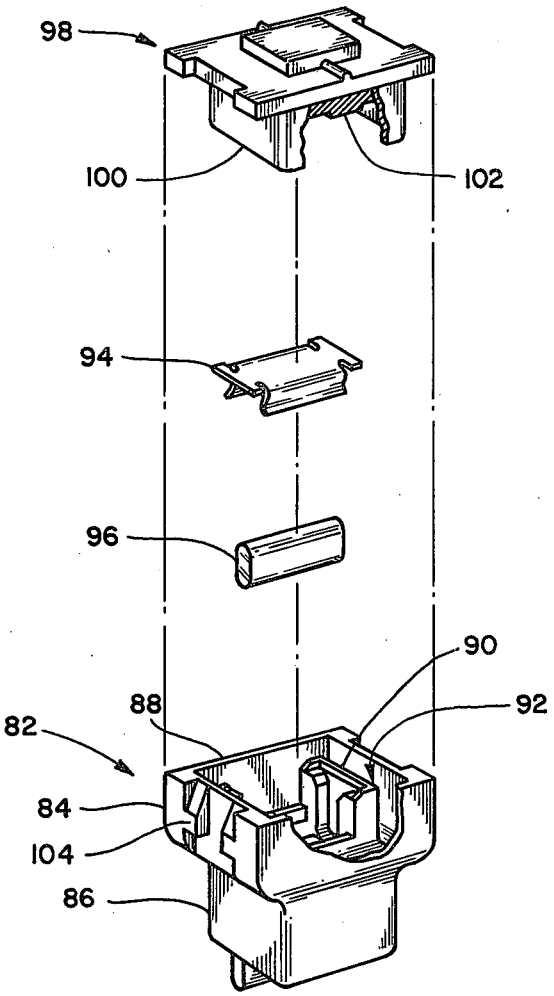
FIG. 10 is an exploded perspective view of the FIGS. 8 and 9 alternative embodiment.
Figure 11:
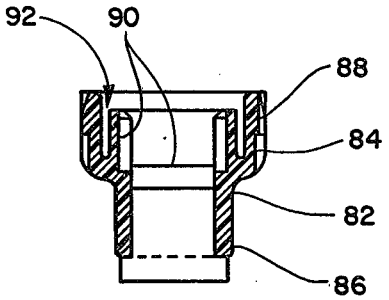
FIGS. 11, 12, and 13 are cross sectional views of parts of the alternative embodiment of the novel switch head.
Figure 12:
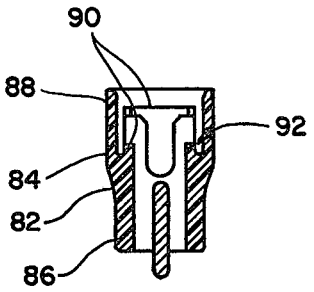
Figure 13:
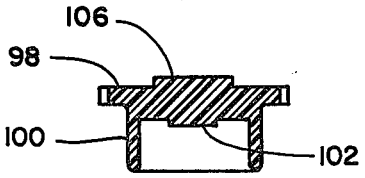

FIG. 8 shows a side view of an alternative embodiment of the present invention. A bar 22 operates on a hanger 80 to move the switch head 20 in a vertical direction to engage and disengage the switch head 20 from first and second stationary conductors 26 and 28. FIGS. 9 and 10 are perspective views showing the parts of the alternative embodiment. In the alternative embodiment pictured, a lower insulating head section or body 82 is provided having first and second ends 84 and 86. The first end 84 has an outer wall 88 and an inner wall 90 contained within the outer wall 88 such that the outer and inner walls 88 and 90 effectively form a continuous channel 92. A biasing means 94 and a contact slug 96 are contained within the body 82. The biasing means 94 and contact slug 96 contact and establish an electrical connection with the first and second stationary conductors 26 and 28 when the switch head 20 engages the conductors.

An upper insulating head section or cap 98 has a raised flange 100 for telescoping engagement with the channel 92 in the body 82. The raised flange 100 of the cap 98 substantially surrounds a center portion 102. The center portion substantially contacts the biasing means 94 in the body 82 for retaining the biasing means 94 in position.

The body 82 has protruding abutments comprising oppositely opposed pairs of ramp-like raised sections 104. A protruding abutment on the cap 98 comprises a substantially rectangular section 106 of predetermined height.

As shown in FIG. 9, a clamping means 108 is provided and comprises a main portion 110 with a substantially rectangular opening 112 for mating with the rectangular section 106 on the cap 98. First and second legs 114 are attached to and oppositely opposed on the main portion 110. Each of the legs 114 has a pair of tabs 116 for engaging the ramp-like raised sections 104 on the body 82. A hanger 80 is attached to the main portion 110 of the clamping means 108. The clamping means 108 places the body 82 and the cap 98 in compression when the switch head 20 engages the first and second stationary conductors 26 and 28; and furthermore, the clamping means 108 applies a force to the body 82 to disengage the switch head 20 from the first and second stationary contacts 26 and 28.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative, not in a limiting sense.

What is claimed is:

1. An improved switch head for engaging and making electrical contact between first and second electrical conductors, said switch head comprising:

(A) lower and upper insulating head sections;

(B) a contact slug contained within said lower insulating head section for contacting and making electrical connection with the first and second conductors;

(C) biasing means operatively positioned within said lower insulating head section to engage and thereby urge the first and second conductors toward oppositely facing surfaces of said slug when the latter is engaged with the first and second conductors;

(D) clamping means for holding said lower and upper insulating head sections together, wherein said clamping means places said lower and upper insulating head sections in compression when the contact slug engages the first and second conductors and wherein said clamping means applies force to said lower head section to disengage the contact slug from the first and second conductors when a force is applied to said clamping means in a direction away from the two conductors;

(E) said lower and upper insulating head sections having protruding abutments on their outer surface for engaging said clamping means; each of said lower and upper insulating head sections having at least two oppositely opposed protruding abutments, said abutments of said lower and upper sections being aligned when said lower and upper insulating head sections are assembled, and wherein said abutment on said lower head section has a groove on a lower end and said abutment on said upper section has a recess on an upper end, said upper head section also has a recess on an upper end, said upper head section also having near each abutment a pair of walls, each wall having a clamp engaging portion;

(F) said clamping means including first and second clamps, each of said clamps comprising:

(1) a main portion having first and second ends and a central opening for surrounding said abutments of said lower and upper head sections, said second end of said main portion engaging said groove in said lower end of said abutment on said lower head section;

(2) a finger attached to said first end of said main portion for engaging said recess in said upper end of said abutment on said upper head section;

(3) a pair of shoulders on said first end of said main portion for engaging said clamp engaging portion of said pair of walls on said upper head sections; and (4) a hanger attached to said first end of said main portion.

2. An improved switch head for engaging and making electrical contact between first and second electrical conductors, said switch head comprising:

(A) a body having first and second ends, said first end having a raised flange;

(B) a contact slug contained within said body for contacting and making electrical connection with the first and second conductors;

(C) biasing means operatively positioned with said body to engage and thereby urge the first and second conductors toward oppositely facing surfaces of said slug when the latter is engaged with the first and second conductors;

(D) a cap having an outer wall and a center portion for mating with said raised flange of said body, said center portion of said cap substantially contacting said biasing means in said body for retaining said biasing means in position;

(E) at least two oppositely opposed protruding abutments on each of said body and said cap, said abutment being aligned when said body and said cap are assembled; each of said abutments on said body having a groove on a lower end and each of said abutments on said cap having a recess on an upper end, said cap also having near each abutment a pair of walls, each wall having a clamp engaging portion; and (F) clamping means including first and second clamps through which operating forces are transmitted to selectively move said contact slug into and out of engagement with the electrical conductors; each of said clamps including:

(1) a main portion having first and second ends and a central opening for surrounding said abutments of said body and said cap, said second end of said main portion engaging said groove in said lower end of said abutment on said body;

(2) a finger attached to said first end of said main portion for engaging said recess in said upper end of said abutment on said cap;

(3) a pair of shoulders on said first end of said main portion for engaging said clamp engaging portion of said pair of walls on said cap; and (4) a hanger attached to said first end of said main portion; wherein said clamping means places said body and said cap in compression when the contact slug engages the first and second conductors and wherein said clamping means applies force to said body to move said cap and said body and thereby disengage the contact slug from the first and second conductors when a force is applied to said clamping means in a direction away from the two conductors.

3. An improved switch head for engaging and making electrical contact between first and second electrical conductors;

when said switch head is disposed for operation by applying vertically directed forces thereto, said switch head comprising:

separate lower and upper insulating head sections;

a contact slug contained within said lower insulating head section for contacting and making electrical connection with the first and second conductors;

biasing means operatively positioned within said lower insulating head section to engage and thereby urge the first and second conductors toward oppositely facing surfaces of said slug when the latter is engaged with the first and second conductors;

clamping means through which operating forces are transmitted to selectively move said contact slug downwardly into engagement with said conductors and inwardly out of engagement with said conductors;

said clamping means holding said lower and upper insulating head sections together, wherein operating forces transmitted through said clamping means place said lower and upper insulating head sections in compression when the contact slug engages the first and second conductors and wherein said clamping means applies force to said lower head section to disengage the contact slug from the first and second conductors when a force is applied to said clamping means in a direction away from the two conductors.

4. The apparatus defined in claim 3, wherein said lower and upper insulating head sections are configured to mate in a vertical telescoping arrangement when said lower and upper insulating head sections are assembled.

5. The apparatus described in claim 3, wherein said lower and upper insulating head sections have protruding abutments on their outer surface for engaging said clamping means.

6. The apparatus described in claim 5, wherein each of said lower and upper insulating head sections has at least two oppositely opposed generally horizontally protruding abutments, said abutments of said lower and upper sections being aligned when said lower and upper insulating head sections are assembled, and wherein each of said abutments on said lower head section has a groove on a lower end and each of said abutments on said upper section has a recess on an upper end, said upper head section also having near each abutment a pair of walls, each wall having a clamp engaging portion.

7. An improved switch head for engaging and making electrical contact between first and second electrical conductors;

when said switch head is disposed for operation by applying vertically directed forces thereto, said switch head comprising:

(A) separate lower and upper insulating head sections;

(B) a contact slug contained within said lower insulating head section for contacting and making electrical connection with the first and second conductors;

(C) biasing means operatively positioned within said lower insulating head section to engage and thereby urge the first and second conductors toward oppositely facing surfaces of said slug when the latter is engaged with the first and second conductors;

(D) clamping means for holding said lower and upper insulating head sections together, wherein said clamping means places said lower and upper insulating head sections in compression when the contact slug engages the first and second conductors through the action of a switch head operating force directed downward and generally parallel to said oppositely facing surfaces of said slug is applied to said clamping means, and wherein said clamping means applies force to said lower head section to disengage the contact slug from the first and second conductors when a force directed upward and generally parallel to said oppositely facing surfaces of said slug is applied to said clamping means in a direction away from the two conductors;

(E) said lower and upper insulating head sections being configured to mate in a vertical telescoping arrangement when said lower and upper insulating head sections are assembled; and (E) said lower insulating head section constituting a body having first and seconds ends, said first end having a raised flange, and wherein said upper insulating head section is a cap having an outer wall and a center portion for mating with said raised flange of said body.

8. The apparatus described in claim 7, wherein said center portion of said cap substantially contacts said biasing means in said body for retaining said biasing means in position.

* * * * *

UNITED STATES PATENT AND TRADEMARK OFFICE

CERTIFICATE OF CORRECTION

PATENT NO. : 4,481,391

DATED : November 6, 1984

INVENTOR(S) : Ralph C. Clement; Charles W. Parmenter; William T. Lockwood

It is certified that error appears in the above-identified patent and that said Letters Patent are hereby corrected as shown below:

Column 3 line 28, correct "seciond" to read --second--.

Column 4 line 24, correct "conductors" to read --conduction--.

Claim 3, column 7 line 7, correct "inwardly" to read --upwardly--.

Signed and Sealed this

*Thirtieth* Day of *July 1985*

[SEAL]

*Attest:*

DONALD J. QUIGG

*Attesting Officer*

*Acting Commissioner of Patents and Trademarks*